US008721029B2

(12) United States Patent
Liu et al.

(10) Patent No.: US 8,721,029 B2
(45) Date of Patent: May 13, 2014

(54) PRINT DEVICE WITH PRINTED SURFACE IDENTIFYING FUNCTION AND PRINTING METHOD

(75) Inventors: Lin Liu, Shenzhen (CN); Ten-Chen Ho, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 130 days.

(21) Appl. No.: 13/456,248

(22) Filed: Apr. 26, 2012

(65) Prior Publication Data

US 2013/0249990 A1 Sep. 26, 2013

(30) Foreign Application Priority Data

Mar. 20, 2012 (CN) ..... 2012 1 0074657

(51) Int. Cl.

| | |
|---|---|
| ***B41J 29/393*** | (2006.01) |
| ***G03G 15/00*** | (2006.01) |
| ***B41J 29/38*** | (2006.01) |
| ***B41J 2/01*** | (2006.01) |

(52) U.S. Cl.
USPC ..... 347/19; 399/49

(58) Field of Classification Search
USPC ..... 347/16, 19, 101; 399/49
See application file for complete search history.

(56) References Cited

U.S. PATENT DOCUMENTS

| | | | | |
|---|---|---|---|---|
| 7,375,832 | B2 * | 5/2008 | Bouverie et al. | 358/1.12 |
| 2008/0013970 | A1 * | 1/2008 | Kikuchi | 399/45 |
| 2010/0079514 | A1 * | 4/2010 | Shibata | 347/7 |

* cited by examiner

*Primary Examiner* — Sarah Al Hashimi
(74) *Attorney, Agent, or Firm* — Novak Druce Connolly Bove + Quigg LLP

(57) ABSTRACT

A print device with a surface identifying function includes a feed roller assembly; a print assembly; an obtaining module; a determining module; a control module; a sliding control module; at least one sliding bar and a printed surface identifying assembly. The sliding control module controls the printed surface identifying assembly to slide along the sliding bar. The obtaining module controls the printed surface identifying assembly to identify if one or both surfaces of the sheet of paper have already been printed, and generates a result. The determining module determines whether the paper is available for printing according to the result. The control module controls the print assembly not to perform the printing task and the feed roller assembly to take the paper out of the print device when the paper is unavailable for printing. A printing method is also provided.

10 Claims, 4 Drawing Sheets

PRINT DEVICE WITH PRINTED SURFACE IDENTIFYING FUNCTION AND PRINTING METHOD

BACKGROUND

1. Technical Field

The present disclosure relates to a print device and a printing method, and more particularly, to a print device with printed surface identifying function and the printing method thereof.

2. Description of Related Art

Printing devices produce text or graphics of documents stored in electronic form on a physical print media such as paper.

However, the print devices of related art are not able to distinguish whether one or both surfaces of a sheet of paper have already been printed. If a printed surface of the paper is put into the print device and not oriented properly, the printed surface of the paper will be double-printed, resulting in a waste of resources and time.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Embodiments of the present disclosure will be described with reference to the accompanying drawings.

Figure 1:
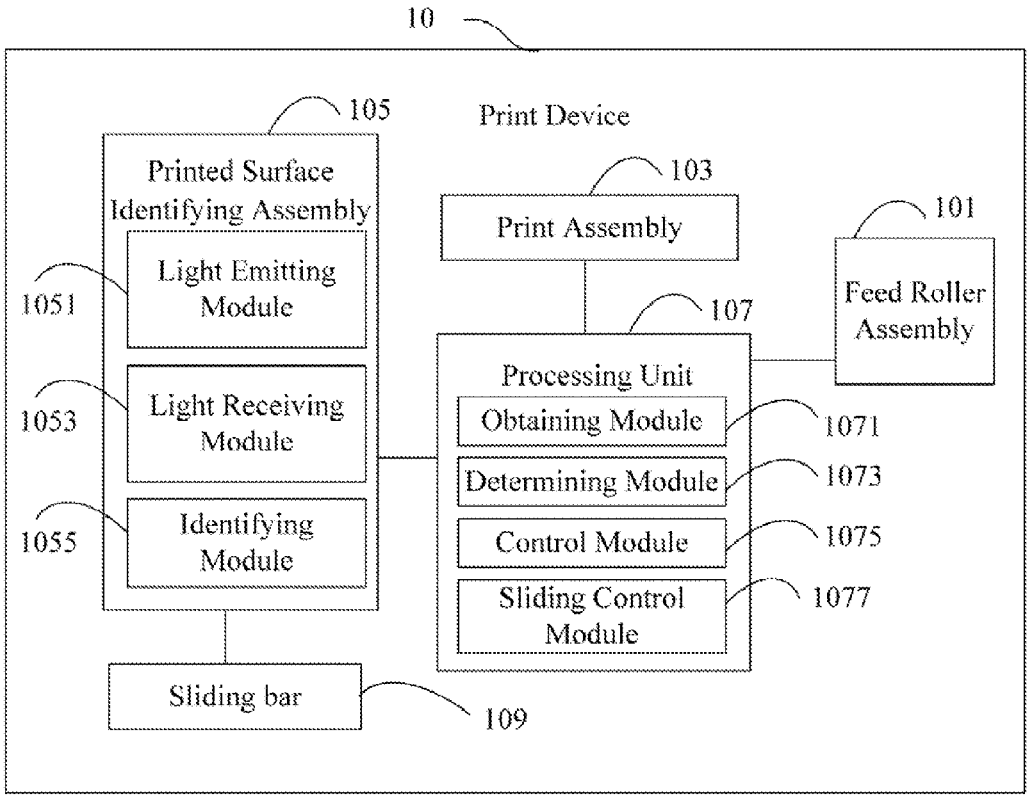
FIG. 1 is a block diagram of an embodiment of a print device with printed surface identifying function, in accordance with the present disclosure.
Figure 2:
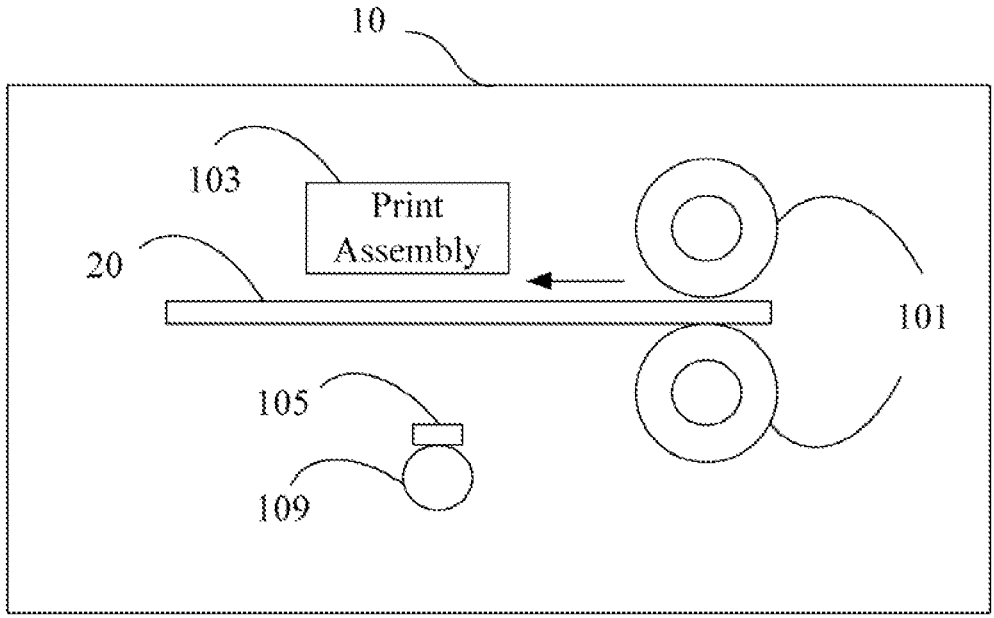
FIG. 2 is a cross-sectional view of the print device in FIG. 1.

Referring to FIG. 1 and FIG. 2, the print device 10 includes a feed roller assembly 101, a print assembly 103, a printed surface identifying assembly 105, a processing unit 107, and one or more sliding bars 109. The print device 10 may be a printer.

The feed roller assembly 101 feeds a sheet of paper into the print device 10 and takes the sheet of paper out of the print device 10 by rotating one or more rollers. The print assembly 103 includes a print head, for depositing ink or other visible material on the paper to form an image, or forms an image by other means.

The sliding bar 109 is installed above or below one surface of the paper being printed in parallel.

The printed surface identifying assembly 105 is installed on the sliding bar 109, and controlled by the processing unit 107 to slide along the sliding bar 109. The printed surface identifying assembly 105 is configured to identify whether one or both surfaces of the paper to be printed have already been printed and send a result to the processing unit 107.

The processing unit 107 is configured to control the feed roller assembly 101 to feed the paper into the print device 10 when receiving a printing task, and determine whether the printing task can be carried out, according to the printing task and the result transmitted by the printed surface identifying assembly 105. The processing unit 107 is further configured to control the print assembly 103 to work and the feed roller assembly 101 to take the paper out of the print device 10 after being printed when the printing task is possible to be carried out, and control the print assembly 103 not to work and the feed roller assembly 101 to take the unprinted paper out of the print device 10 when the printing is not possible, that is to say, when the surface of the paper to be printed has already been printed for example.

The printed surface identifying assembly 105 includes a light emitting module 1051, a light receiving module 1053, and an identifying module 1055. The functions of the units (shown in FIG. 1) will be described and correlated with the method illustrated in FIG. 3.

Figure 4:
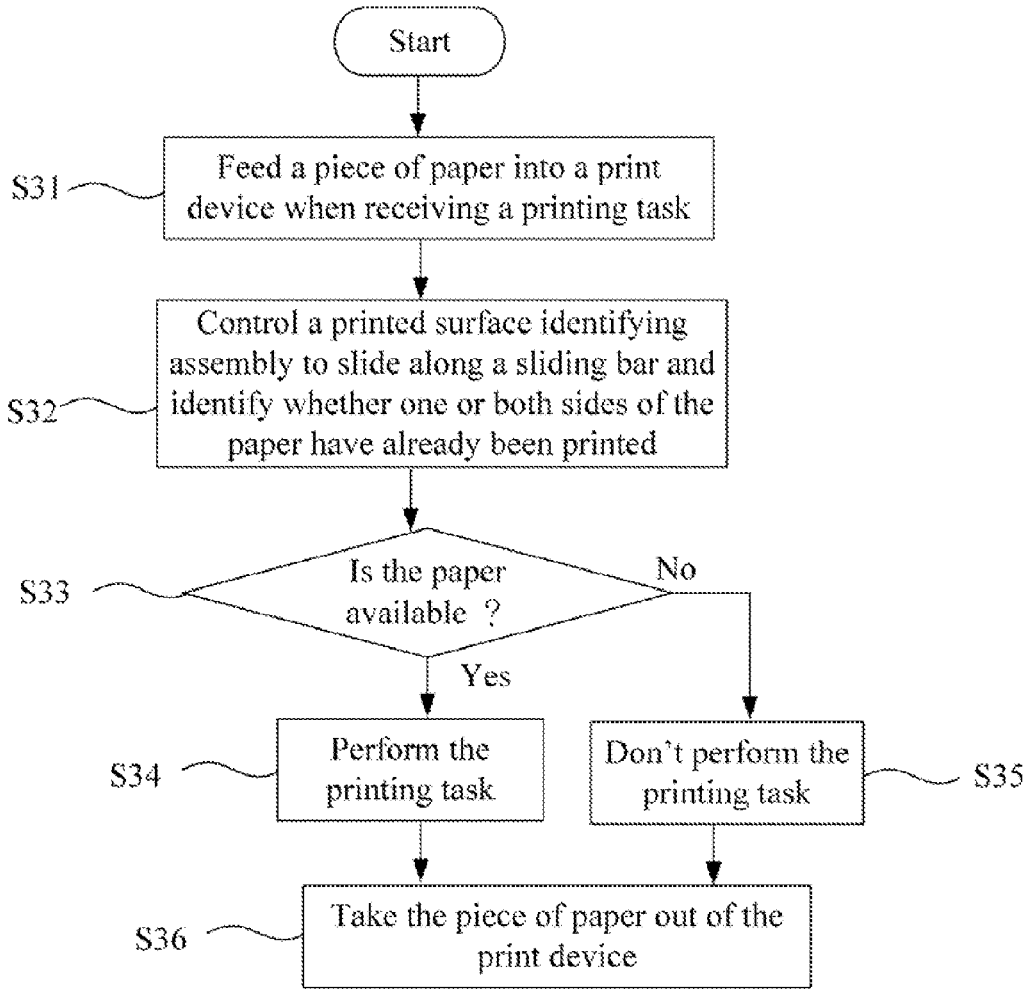
FIG. 4 is a flowchart of an embodiment of a process of performing a printing task as implemented by the print device in FIG. 1, in accordance with the present disclosure.

The processing unit 107 includes an obtaining module 1071, a determining module 1073, and a control module 1075. The functions of the modules (shown in FIG. 1) will be described and correlated with the method illustrated in FIG. 4.

FIG. 2 is a flowchart of an embodiment of a printed surface identifying process implemented by the print device in FIG. 1. In step S21, the light emitting module 1051 emits uniform light onto the surface of the paper to be printed. The light emitting module 1051 may be an illuminant, installed over or under the surface of the paper being printed.

In step S22, the light receiving module 1053 receives light reflected from the surface of the paper. The light receiving module 1053 and the light emitting module 1051 are installed together over or under one surface of the paper being printed.

In step S23, the identifying module 1055 periodically determines whether the reflected light is uniform, if the reflected light in multiple identifying periods is uniform, the procedure goes to step S25. If the reflected light in multiple identifying periods is not uniform, the procedure goes to step S24. The identifying period is same as a cycle period of the identifying module 1055. The method of determining whether the reflected light is sufficiently uniform to indicate a blank or print-ready surface can be referenced from correlated knowledge.

In step S24, the identifying module 1055 determines that the surface of the paper to be printed has already been printed.

In step S25, the identifying module 1055 determines that the surface of the paper to be printed has not been printed.

Figure 3:
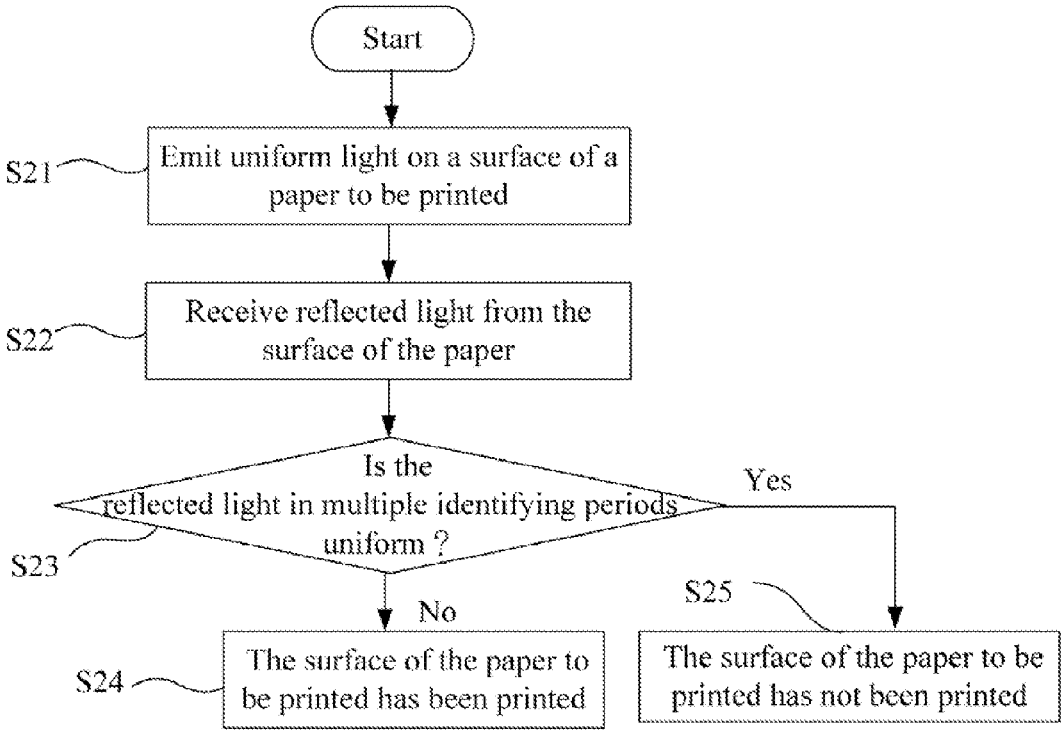
FIG. 3 is a flowchart of an embodiment of printed surface identifying process implemented by the print device in FIG. 1, in accordance with the present disclosure.

FIG. 3 is a flowchart of an embodiment of performing a print task as implemented by the print device in FIG. 1.

In step S31, the obtaining module 1071 controls the feed roller assembly 101 to feed the paper into the print device 10 when receiving a printing task.

In step S32, the printed surface identifying assembly 105 is controlled by the sliding control module 1077 to slide along the sliding bar 109, and identifies whether the surface of the paper to be printed has already been printed, generates the result and sends the result to the obtaining module 1071.

When the printing task is one-sided printing, the printed surface identifying assembly 105 only needs to identify whether the surface of the paper to be printed has already been printed. When the printing task is double-sided printing, the printed surface identifying assembly 105 needs to identify whether both surfaces of the paper have already been printed.

In step S33, the determining module 1073 determines whether the paper is available for printing according to the printing task and the result. If yes, the procedure goes to step S34, if no, the procedure goes to step S35.

The method of determining whether the paper is available for printing is: when the printing task is one-sided printing and the result is that the surface of the paper to be printed has not already been printed, determining that the paper is available for printing; when the printing task is one-sided printing and the result is that the surface of the paper to be printed has already been printed, determining that the paper is unavailable for printing; when the printing task is double-sided printing and the result is that both surfaces of the paper being printed are blank, determining that the paper is available for printing; when the printing task is double-sided printing and the result is that one surface or both surfaces of the paper have already been printed, then determining the paper is unavailable for printing.

In step S34, the control module 1075 controls the paper 103 to perform the printing task, and then the procedure goes to S36.

In step S35, the control module 1075 controls the paper 103 not to perform the printing task, and the procedure goes to S36.

In step S36, the control module 1075 controls the feed roller assembly 101 to take the paper out of the print device 10.

In other embodiments, the print device 10 has two exits. When the paper is determined to be available for printing, the control module 1075 controls the feed roller assembly 101 to take the paper out of the print device 10 from one exit (post-print exit) after printing. When the paper is determined not to be available for printing, the control module 1075 controls the feed roller assembly 101 to take the paper out of the print device 10 from the other exit (nonprint exit) directly.

The present disclosure identifies if the paper is available for printing via the printed surface identifying assembly 105, and performs the printing task only after identifying that the paper is available for printing, which saves resources and time.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A print device with printed surface identifying function, comprising:

a feed roller assembly;

a print assembly;

a processing unit, further comprising an obtaining module, a determining module, a control module, and a sliding control module;

at least one sliding bar, installed above or below one surface of the paper being printed in parallel; and a printed surface identifying assembly, installed on the at least one sliding bar, and controlled by the sliding control module to slide along the sliding bar, and configured to identify if one or both surfaces of a sheet of paper have already been printed, and generate and send a result to the processing unit;

wherein the obtaining module controls the printed surface identifying assembly to identify if one or both surfaces of the sheet of paper have already been printed and generates the result, the determining module determines whether the paper is available for printing according to the result, and the control module controls the print assembly not to perform the printing task and the feed roller assembly to take the paper out of the print device when the paper is unavailable for printing.

2. The print device of claim 1, wherein the printed surface identifying assembly further comprises a light emitting module configured to emit uniform light onto one surface of the paper to be printed, a light receiving module configured to receive reflected light from the surface of the paper, and an identifying module configured to periodically determine whether the reflected light is uniform thereby determining the surface of the paper to be printed has not been printed when the reflected light in multiple identifying periods is uniform and the surface of the paper to be printed has already been printed when the reflected light in multiple identifying periods is not uniform, the identifying period is same as a cycle period of the identifying module.

3. The print device of claim 2, wherein the print device comprising two exits, when the paper is determined to be available for printing, the processing unit controls the feed roller assembly to take the paper out of the print device from one exit after printing, when the paper is determined not to be available for printing, the processing unit controls the feed roller assembly to take the paper out of the print device from the other exit directly.

4. The print device of claim 1, wherein when the printing task is one-sided printing, the printed surface identifying assembly only needs to identify whether the surface of the paper to be printed has already been printed, and when the printing task is double-sided printing, the printed surface identifying assembly needs to identify whether both surfaces of the paper have already been printed.

5. The print device of claim 1, wherein the determining module determines whether the paper is available for printing according to: when the printing task is one-sided printing and the result is that the surface of the paper to be printed has not already been printed, determining that the paper is available for printing; when the printing task is one-sided printing and the result is that the surface of the paper to be printed has already been printed, determining that the paper is unavailable for printing; when the printing task is double-sided printing and the result is that both surfaces of the paper being printed are blank, determining that the paper is available for printing; when the printing task is double-sided printing and the result is that one surface or both surfaces of the paper have already been printed, then determining the paper is unavailable for printing.

6. A printing method comprising:

supplying a print device comprising a feed roller assembly, a print assembly, at least one sliding bar, installed above or below one surface of the paper being printed in parallel, and a printed surface identifying assembly installed on the at least one sliding bar;

controlling the feed roller assembly to feed the paper into the print device when receiving a printing task;

controlling the printed surface identifying assembly to slide along the sliding bar and identify whether one or both surfaces of a sheet of paper have already been printed and generates the result;

determining whether the paper is available for printing according to the result; and controlling the print assembly not to perform the printing task and the feed roller assembly to take the paper out of the print device when the paper is unavailable for printing.

7. The printing method of claim 6, wherein the printed surface identifying assembly further comprises a light emitting module, a light receiving module and an identifying module, and the method further comprises:

controlling the light emitting module to emit uniform light onto one surface of the paper to be printed;

controlling the light receiving module to receive reflected light from the surface of the paper, and controlling the identifying module to periodically determine whether the reflected light is uniform thereby determining the surface of the paper to be printed has already been printed when the reflected light in multiple identifying periods is not uniform and the surface of the paper to be printed has not already been printed when the reflected light in multiple identifying periods is uniform, the identifying period is same as a cycle period of the identifying module.

8. The printing method of claim 7, wherein the print device further comprises two exits, the method of controlling the print assembly not to perform the printing task and the feed roller assembly to take the paper out of the print device when the paper is unavailable for printing further comprises: when the paper is determined to be available for printing, controlling the feed roller assembly to take the paper out of the print device from one exit after printing, when the paper is determined not to be available for printing, controlling the feed roller assembly to take the paper out of the print device from the other exit directly.

9. The printing method of claim 6, wherein the step of controlling the printed surface identifying assembly to identify whether one or both surface of the paper have already been printed and generating a result further comprises: when the printing task is one-sided printing, the printed surface identifying assembly only needs to identify whether the surface of the paper to be printed has already been printed, and when the printing task is double-sided printing, the printed surface identifying assembly needs to identify whether both surfaces of the paper have already been printed.

10. The printing method of claim 6, wherein the step of determining whether the paper is available for printing according to the printing task and the result further comprises: when the printing task is one-sided printing and the result is that the surface of the paper to be printed has not already been printed, determining that the paper is available for printing; when the printing task is one-sided printing and the result is that the surface of the paper to be printed has already been printed, determining that the paper is unavailable for printing; when the printing task is double-sided printing and the result is that both surfaces of the paper being printed are blank, determining that the paper is available for printing; when the printing task is double-sided printing and the result is that one surface or both surfaces of the paper have already been printed, then determining the paper is unavailable for printing.

* * * * *